US010533285B2

(12) United States Patent
Candutti

(10) Patent No.: US 10,533,285 B2
(45) Date of Patent: Jan. 14, 2020

(54) SYSTEM AND A METHOD FOR COLLECTING AND HANDLING DUST IN A PAPER-MAKING ENVIRONMENT

(71) Applicant: VALMET S.P.A., Milan (IT)
(72) Inventor: Massimiliano Candutti, Gorizia (IT)
(73) Assignee: VALMET S.P.A., Milan (IT)

( * ) Notice: Subject to any disclaimer, the term of this patent is extended or adjusted under 35 U.S.C. 154(b) by 0 days.
(21) Appl. No.: 16/339,673
(22) PCT Filed: Sep. 14, 2017
(86) PCT No.: PCT/EP2017/073129
§ 371 (c)(1),
(2) Date: Apr. 4, 2019
(87) PCT Pub. No.: WO2018/065185
PCT Pub. Date: Apr. 12, 2018
(65) Prior Publication Data
US 2019/0242061 A1 Aug. 8, 2019
(30) Foreign Application Priority Data
Oct. 5, 2016 (EP) ..... 16192354
(51) Int. Cl.
*D21G 3/00* (2006.01)
*D21G 9/00* (2006.01)
(Continued)
(52) U.S. Cl.
CPC ..... *D21G 3/00* (2013.01); *D21F 5/00* (2013.01); *D21G 5/00* (2013.01); *D21G 7/00* (2013.01); *D21G 9/00* (2013.01)
(58) Field of Classification Search
CPC ... D21G 3/00; D21G 9/00; D21G 7/00; B08B 5/00; B08B 5/026; B08B 15/00; B08B 5/046; B65H 2801/84; Y10S 261/09
See application file for complete search history.

(56) References Cited

U.S. PATENT DOCUMENTS 3,063,221 A * 11/1962 Ortgies ..... B01D 47/024 261/110
3,763,634 A * 10/1973 Alliger ..... B01D 47/06 96/271
(Continued)

FOREIGN PATENT DOCUMENTS

EP 0870869 A1 * 10/1998 ..... B08B 5/00
EP 3305980 A1 * 4/2018 ..... D21F 5/00
(Continued)

OTHER PUBLICATIONS

International Search Report and Written opinion for International Application No. PCT/EP2017/073129 dated Dec. 8, 2017.

*Primary Examiner* — Jose A Fortuna
(74) *Attorney, Agent, or Firm* — Alston & Bird LLP

(57) ABSTRACT

The invention relates to a system (1) and a method for collecting and handling dust in a paper-making environment. The system (1) comprises a source of underpressure (2) and an elongated collector (4) that extends along a longitudinal axis and which elongated collector (4) is connected to the source of underpressure (2) through at least one suction duct (7) such that underpressure can be generated inside the elongated collector (4). The elongated collector (4) has an inlet (5) through which dust-laden air can enter the elongated collector (4) and an exit opening (6) leading to the suction duct (7) through which exit opening (6) dust-laden air can be evacuated from the elongated collector (4). A source of water (8) is connected by at least one water supply duct (10) to the elongated collector (4) such that water from the source of water (8) can be introduced into the elongated collector so that dust in the dust-laden air can be exposed to and mix with the water introduced into the elongated collector (4). A flow meter (12) is functionally connected to the system (1) to measure at least one of a flow of water from the source of water (8) to the elongated collector (4) or a flow of water exiting from the elongated collector (4) through the exit opening (6) of the elongated collector (4) and arranged to send a signal indicating a numerical value for a flow of water that reaches or leaves the elongated collector (4) such that this value can be compared to a predetermined minimum value. The system is used to carry out the inventive method.

8 Claims, 7 Drawing Sheets

(51) Int. Cl.

| | |
|---|---|
| ***D21F 5/00*** | (2006.01) |
| ***D21G 5/00*** | (2006.01) |
| ***D21G 7/00*** | (2006.01) |

(56) References Cited

U.S. PATENT DOCUMENTS 4,019,953 A * 4/1977 Nystrom ..... D21G 3/00 162/272
4,400,148 A * 8/1983 Lawrence ..... D04H 1/732 264/121
5,635,031 A * 6/1997 Enkvist ..... D21F 7/00 162/199
5,800,679 A * 9/1998 Lindstrom ..... B08B 5/026 162/272
5,878,462 A * 3/1999 Linden ..... D21G 3/00 15/309.1
6,014,790 A * 1/2000 Smith ..... A47L 5/18 15/302
6,033,303 A * 3/2000 Green ..... F24F 3/1607 454/252
6,068,735 A * 5/2000 Marchal ..... B08B 1/00 162/272
6,176,898 B1 1/2001 Courtney et al.
6,565,711 B1 * 5/2003 Kleissler, Jr. ..... B08B 5/00 134/15
8,034,192 B2 10/2011 Ringer et al.
8,118,942 B2 * 2/2012 Featherson ..... B08B 5/026 134/15
9,725,852 B1 * 8/2017 Kelyman ..... D21F 7/00
10,023,996 B1 * 7/2018 Kelyman ..... D21G 9/00
2009/0126764 A1 * 5/2009 Ringer ..... D21G 3/00 134/21

FOREIGN PATENT DOCUMENTS

JP 62191015 A * 8/1987
JP 2009121017 A * 6/2009 ..... D21G 3/00
WO WO-0061264 A1 * 10/2000 ..... B01D 45/12

* cited by examiner

SYSTEM AND A METHOD FOR COLLECTING AND HANDLING DUST IN A PAPER-MAKING ENVIRONMENT

CROSS REFERENCE TO RELATED APPLICATIONS

This application is a National Stage Application, filed under 35 U.S.C. § 371, of International Application No. PCT/EP2017/073129, filed Sep. 14, 2017, which international application claims priority to and the benefit of European Application No. 16192354.5, filed Oct. 5, 2016; the contents of both of which as are hereby incorporated by reference in their entirety.

BACKGROUND

Related Field

The present invention relates to a system and a method for collecting and handling dust in a paper-making environment.

Description of Related Art

In a room in which a papermaking machine is used for making tissue paper, a large amount of dust is generated. For example, dust may be generated when a tissue paper web is doctored off from a Yankee drying cylinder. The dust generated can result in worker health hazards and cleanliness problems. In addition, the dust may increase the risk of fire since dust-laden air can be flammable. Therefore, it is customary to seek to evacuate dust-laden air from the area of the paper-making machine. A known device for collecting and handling dust in a paper-making environment is disclosed in U.S. Pat. No. 6,176,898. That document discloses a device and a process in which an elongated collector with an inlet and an exit opening is used. A vacuum-generating source is connected to the collector and dust-laden air can be drawn into the collector such that air vortex is induced that flows between the inlet and the exit opening. Water is introduced into the collector such that it collides with the dust-laden air and encapsulates dust particles. The introduction of water can rinse the interior walls of the collector such that the interior of the collector remains in a relatively clean condition and the dust is wetted. The wetting of the dust also reduced the risk of fire. A dust collector in which water is introduced is also disclosed in U.S. Pat. No. 8,034,192. The object of the present invention is to provide an improved design for dust-handling devices using the principle of introducing water. In particular, it is an object of the present invention to achieve a dust collector with improved reliability of operation.

BRIEF SUMMARY

The invention relates to a system for collecting and handling dust in a paper-making environment. The inventive system comprises a source of underpressure and an elongated collector that extends along a longitudinal axis and which elongated collector is connected to the source of underpressure through at least one suction duct such that underpressure can be generated inside the elongated collector. The elongated collector has an inlet through which dust-laden air can enter the elongated collector and an exit opening leading to the suction duct through which exit opening dust-laden air can be evacuated from the elongated collector. A source of water is connected by at least one water supply duct to the elongated collector and at least one pump may optionally be arranged to feed water from the source of water through the water supply duct to the elongated collector such that water can be introduced into elongated collector. When water is introduced into the elongated collector, dust in the dust-laden air can be exposed to and mix with the water introduced into the elongated collector. According to the invention, a flow meter is functionally connected to the system to measure at least one of a flow of water from the source of water to the elongated collector or a flow of water exiting from the elongated collector through the exit opening of the elongated collector. The flow meter is arranged to send a signal indicating a numerical value for a flow of water that reaches or leaves the elongated collector such that this value can be compared to a predetermined minimum value.

In embodiments of the invention, the inlet of the elongated collector is disposed in such a relation to the longitudinal axis of the elongated collector that, upon drawing the dust-laden air into the elongated collector, an air vortex is induced with the dust-laden air wherein the induced air vortex flows between the collector inlet and the collector exit opening.

In embodiments of the invention, the flow meter is arranged to send the signal to a display that indicates the current value of the flow of water that reaches or leaves the elongated collector such that a human operator can compare that value to the predetermined minimum value.

In other embodiments of the invention, the flow meter is connected to a logic control unit and arranged to send the signal to the logic control unit. In such embodiments the logic control unit is preferably arranged to be able to control at least one of the source of underpressure or a valve in the suction duct such that the logic control unit is capable of reducing the underpressure that is generated inside the elongated collector. The logic control unit is then set (programmed) to reduce the underpressure that is generated in the elongated collector when the signal from the flow meter indicates that the flow of water is below a predetermined value.

The source of underpressure may comprise a fan and the logic control unit may be connected to the fan and set to reduce the action of the fan when the signal from the flow meter indicates that the flow of water is lower than the predetermined minimum value.

In embodiments of the invention, the logic control unit is may be set to completely interrupt the operation of the fan when the signal from the flow meter indicates that the flow of water is lower than the predetermined minimum value.

The flow meter may optionally be placed in the water supply duct that leads from the source of water to the elongated collector.

In other embodiments of the invention, the system may comprise a control valve located in the suction duct and connected to the logical control unit such that the logical control unit can control the action of the control valve and wherein the logical control unit is set to activate the control valve to reduce underpressure in the elongated collector.

The logic control unit may be set to completely interrupt connection between the source of underpressure and the elongated collector.

The invention can also be defined in terms of a method of collecting and handling dust in a paper-making environment. The inventive method comprises: providing a source of underpressure; providing an elongated collector that extends along a longitudinal axis and connecting the elongated collector to the source of underpressure such that an underpressure is generated inside the elongated collector that draws dust-laden air and into the elongated collector. The elongated collector has an inlet through which dust-laden air can enter the elongated collector and an exit opening leading to the suction duct through which exit opening dust-laden air can be evacuated from the elongated collector. In the method, water is supplied from the source of water to the elongated collector through a supply duct connected to the elongated collector such that water is introduced into the elongated collector. When water is supplied to the elongated collector, the water mixes with the dust in the dust-laden air and leaves the elongated collector through the exit opening so that there will also be a flow of water leaving the elongated collector. The inventive method comprises measuring at least one of the flow of water in the supply duct or the flow of water leaving the elongated collector and comparing the measured flow to a predetermined minimum value.

The method may optionally also comprise reducing the underpressure that is generated in the elongated collector if the measurement indicates that the flow of water is lower than a predetermined minimum value.

In embodiments of the invention, the generation of underpressure in the elongated collector is interrupted completely if the measurement indicates that the flow of water is lower than a predetermined minimum value.

DETAILED DESCRIPTION OF VARIOUS EMBODIMENTS

Figure 1:
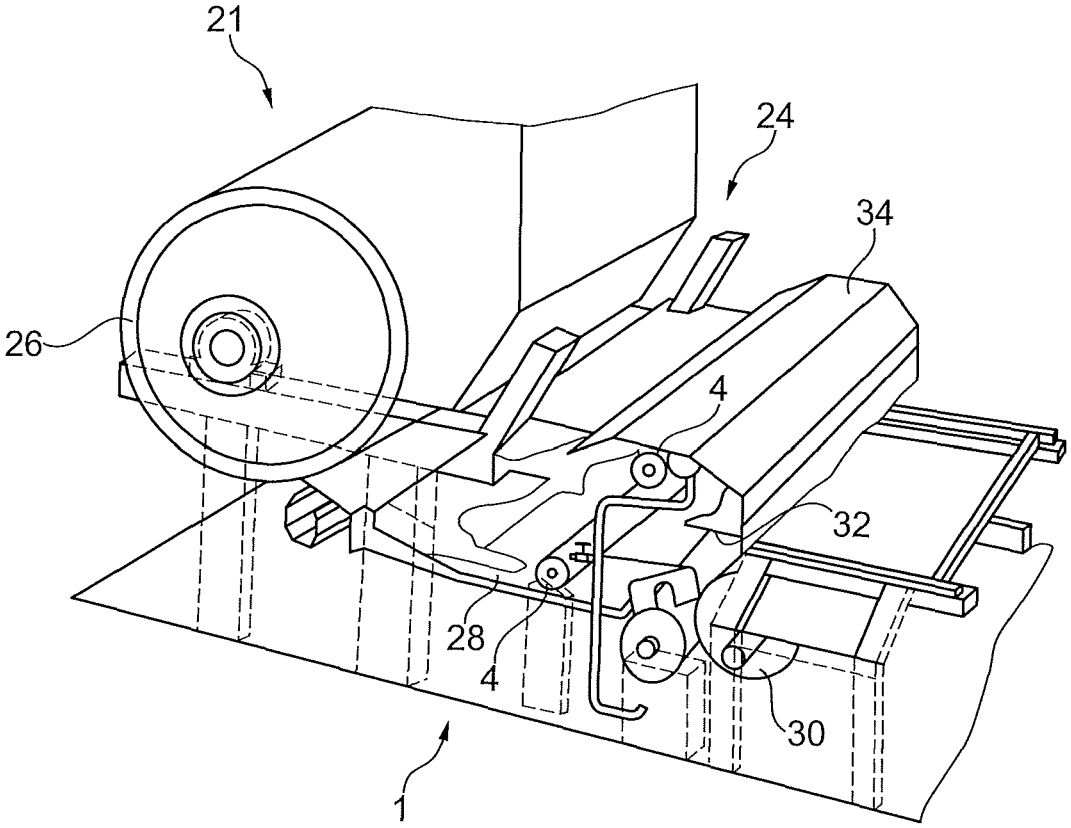
Fig. 1 (Prior Art)
FIG. 1 is a perspective view of a fragment of a papermaking machine with which the present invention may be used.

Reference will first be made to FIG. 1 that shows a perspective view of a fragment of a papermaking machine with which an embodiment of a dust handling system is employed. The reference numeral 21 indicates the environment in which the present invention is to be used and the reference numeral 24 indicates a part of a paper making machine. In a practical case, the paper making machine includes a cylinder 26 which is normally a drying cylinder such as a Yankee drying cylinder from which a dried paper web 28 is sent further to be rolled up into a roll of paper 30. At this stage, a large amount of dust from the paper making process may be filling the environment of the paper making machine. This is in particular the case when the paper web 28 has been creped off from the cylinder 26 by a doctor blade. The dust in the air may contain fibers but also remnants of clay, starch and chemicals used in the paper making process. To decrease worker health hazard and the risk of fire, the paper making machine is provided with a dust handling system generally indicated by the reference numeral 1. A canopy hood 34 is used to create a confined space 32 from which dust can be evacuated by means of one or several dust-handling devices. The dust handling system 1 comprises one or several elongated collectors 4 that are dust collectors as will be explained in the following. The elongated collectors 4 are provided with inlets through which dust can be drawn in and subsequently evacuated.

Figure 2:
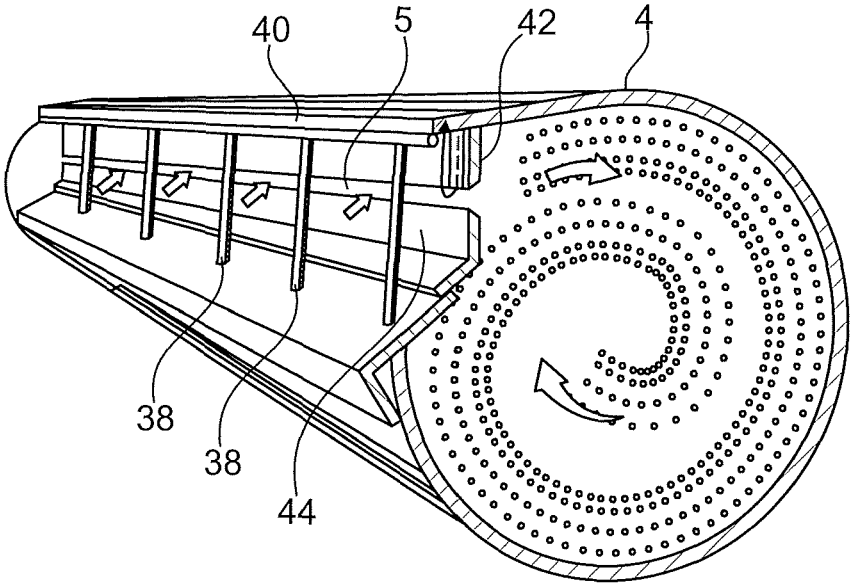
Fig. 2 (Prior Art)
FIG. 2 is a perspective view, partially in section, of an elongated dust collector that may be used in embodiments of the invention.

With reference to FIG. 2, the elongated collector or collectors 4 may be designed as shown in, for example, U.S. Pat. No. 6,176,898. FIG. 2 shows a collector as shown in that patent. As can be seen in FIG. 2, the elongated collector 4 extends along a longitudinal axis and has an inlet 5 through which dust-laden air can enter the elongated collector 4. In the embodiment of FIG. 2, the inlet 5 is formed between two wall parts 42, 44 and the inlet 5 can be understood as a slot that extends in the longitudinal direction of the elongated collector 4, i.e. parallel to the longitudinal axis of the elongated collector 4. The wall part 42 may be connected to an overhang part of the elongated collector 4 and the inlet 5 may optionally have an inlet guard formed by guard bars 38. In other embodiments, the inlet 5 may be formed by simply bending a metal sheet used to form the elongated collector 4. The skilled person will understand that the inlet 5 may be formed in many other ways.

Figure 3:
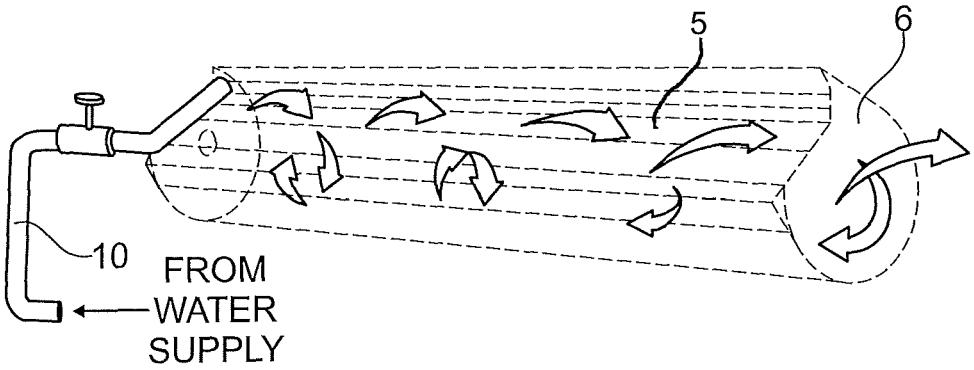
FIG. 3 is a perspective view illustrating the flow of dust and water in an elongated dust collector.
Figure 4:
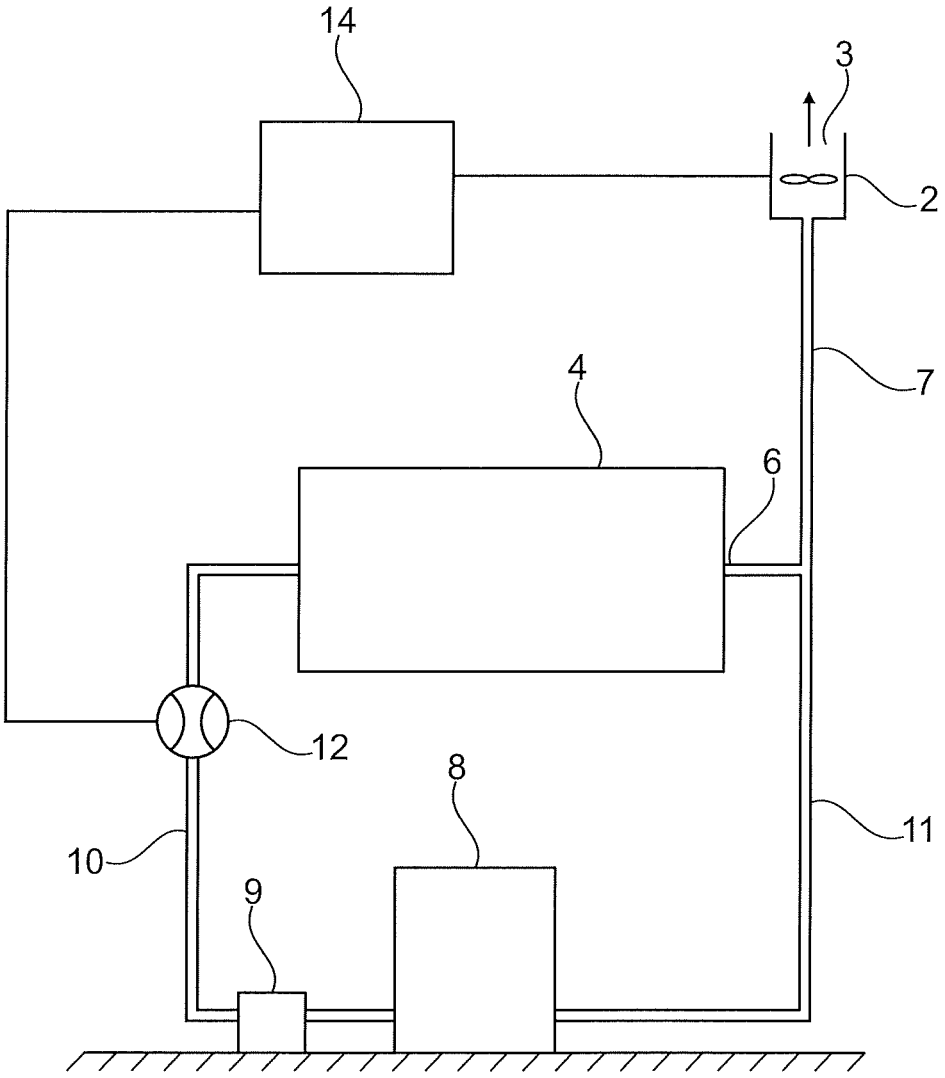
FIG. 4 is a schematic representation of how different components may be connected to each other in a first embodiment of the present invention.

With further reference to FIG. 3 and FIGS. 4-7, it can be seen that the elongated collector 4 has an exit opening 6 through which dust-laden air and water can be evacuated from the elongated collector 4. With further reference to FIG. 3 and FIG. 4, a water supply duct 10 is connected to the elongated collector 4 such that water from a source of water 8 can be introduced into the elongated collector 4. With reference to FIG. 4, a source of underpressure 2 is connected to the elongated collector 4 through at least one suction duct 7 such that underpressure can be generated inside the elongated collector 4. The suction duct 7 is connected to the exit opening 6 such that the exit opening 6 leads to the suction duct 7. The reference numeral 3 in FIG. 4 represents a fan that can be used to produce the underpressure. When the source of underpressure 2 is connected to the elongated collector 4 and the source of underpressure 2 is active, e.g. when the fan 3 is operating, the underpressure reaches the elongated collector 4 such that an underpressure is generated inside the elongated collector 4 and dust-laden air can be drawn into and enter the elongated collector 4 through the inlet 5.

In preferred embodiments of the invention, the inlet 5 of the elongated collector 4 is disposed in such a relation to the longitudinal axis of the elongated collector 4 that upon drawing the dust-laden air into the elongated collector 4, an air vortex is induced with the dust-laden air wherein the induced air vortex flows between the collector inlet 5 and the collector exit opening 6.

In advantageous embodiments, at least one pump 9 is arranged to feed water from the source of water 8 through the at least one supply duct 10 to the elongated collector 4. Such a pump 9 may allow recirculation of the water being used. However, it should be understood that the pump 9 is an optional feature and that embodiments without a pump may be contemplated. For example, the water could be taken from a from a source of water 8 that is located at a higher level than the elongated collector 4 or from the main water supply and the water that is used for the process need not necessarily be recirculated.

Through the water supply duct 10, water can be introduced to the elongated collector 4 such that water from the source of water can be introduced into the elongated collector so that dust in the dust-laden air can be exposed to and mix with the water introduced into the elongated collector. For further explanation of how this may be arranged in detail, reference is made to U.S. Pat. No. 6,176,898. However, it should be understood that the exact design of the elongated collector 4 and the water supply need not be exactly according to U.S. Pat. No. 6,176,898. Variations are possible and the elongated collector 4 and the water supply could be designed in other ways, for example as disclosed in U.S. Pat. No. 8,034,192 and for further explanation of how the elongated collector 4 may be designed, reference is made also to U.S. Pat. No. 8,034,192. It should be understood, however, that the present invention is not limited to the exact embodiments disclosed in those two patents but could be used in any dust collecting system in a paper making environment in which a collector draws in dust laden air which is evacuated through an exit opening and in which water is simultaneously introduced into the elongated collector.

Dust collecting systems according to U.S. Pat. No. 6,176,898 or 8,034,192 represent a significant improvement over arrangements in which water is not introduced. One reason for this is that the hazard of fire is significantly reduced. However, the inventor of the present invention has recognized that such systems may fail to operate properly if, for any reason, the supply of water is interrupted. One reason that the water supply may be interrupted is if water is recirculated. Fibers and other particles emanating from the paper production process may clog the water supply duct such that the water supply is reduced or even totally interrupted. Other reasons may include, for example, a leaking water supply duct or a malfunctioning pump.

If, for any reason, the quantity of water that is introduced into the elongated collector 4 should be significantly reduced or if the supply of water should be completely interrupted, the dust particles in the dust-laden air that is drawn into the elongated collector will no longer be sufficiently encapsulated in water droplets. As a consequence, the air that is evacuated from the elongated collector 4 will contain dry dust particles that may lead to fire hazard and possibly also an environment that is detrimental to the health of personnel in the papermaking environment.

To solve this problem, the inventors of the present invention have found that a flow meter can be arranged to measure at least one of the flow of water that comes from the source of water 8 to the elongated collector 4 or a flow of water exiting the elongated collector 4 through the exit opening 6 together with dust and air. The flow meter 12 is arranged to send a signal indicating a numerical value for a flow of water that reaches or leaves the elongated collector 4 such that this value can be compared to a predetermined minimum value.

With reference to FIG. 4, the system may comprise a source of water 8 and a pump 9 that sends water from the source of water 8 to the elongated collector 4 through a water supply duct 10. A flow meter 12 is functionally connected to the system 1 to measure the flow of water through the water supply duct. Preferably, the flow meter 12 may be placed in the water supply duct.

In the embodiment of FIG. 4, the flow meter 12 is connected to a logic control unit 14 and arranged to send the signal to the logic control unit 14. The logic control unit 14 is connected to the source of underpressure 2 and is capable of controlling the source of underpressure 2. This can be done, for example, by controlling the fan 3. For example, the fan 3 can be ordered by the logic control unit to reduce its speed of rotation (rotations per unit of time) such that the suction effect is reduced and less underpressure is generated in the elongated collector 4. Alternatively, the fan could be ordered to change the pith of the fan blades to change the effect of the fan, in particular to reduce the effect from the fan 3. When the effect of the fan 3 is so reduced, the underpressure in the suction duct 7 that leads from the source of underpressure 2 to the exit opening 6 of the elongated collector 4 will also be reduced. In this way, the underpressure generated inside the elongated collector 4 itself will be reduced. Therefore, the logic control unit 14 is capable of reducing the underpressure that is generated inside the elongated collector 4. In the embodiment of FIG. 4, the logic control unit 14 is set to (i.e. programmed to) reduce the underpressure that is generated in the elongated collector 4 when the signal from the flow meter 12 indicates that the flow of water is below a predetermined value, i.e. when the signal from the flow meter 12 indicates to the logic control unit 14 that the water flow is insufficient.

In embodiments of the invention, the logic control unit 14 is set to completely interrupt operation of the source of underpressure 2 when the signal from the flow meter 12 indicates that the water flow is insufficient, i.e. below a predetermined minimum value. In embodiments of the invention, the flow meter 12 may be set to give an early warning signal when the flow of water has gone slightly below a set value, for example 90% of the set value. This must not necessarily result in interruption of the source of underpressure but a warning may be displayed to a human operator who can then check whether the flow of water is sufficient for continued operation. The flow meter 12 may thus be arranged to send two signals, one "early warning signal" when the flow of water has decreased by just a small amount and one "shut-off signal" (or "reduce underpressure" signal).

It should be noted that the predetermined minimum value may be the value for water flow that the system has been set to deliver such that the operation of the source of underpressure is reduced or interrupted as soon as the flow meter 12 indicates any decrease at all in the flow of water through the water supply duct 10.

Figure 5:
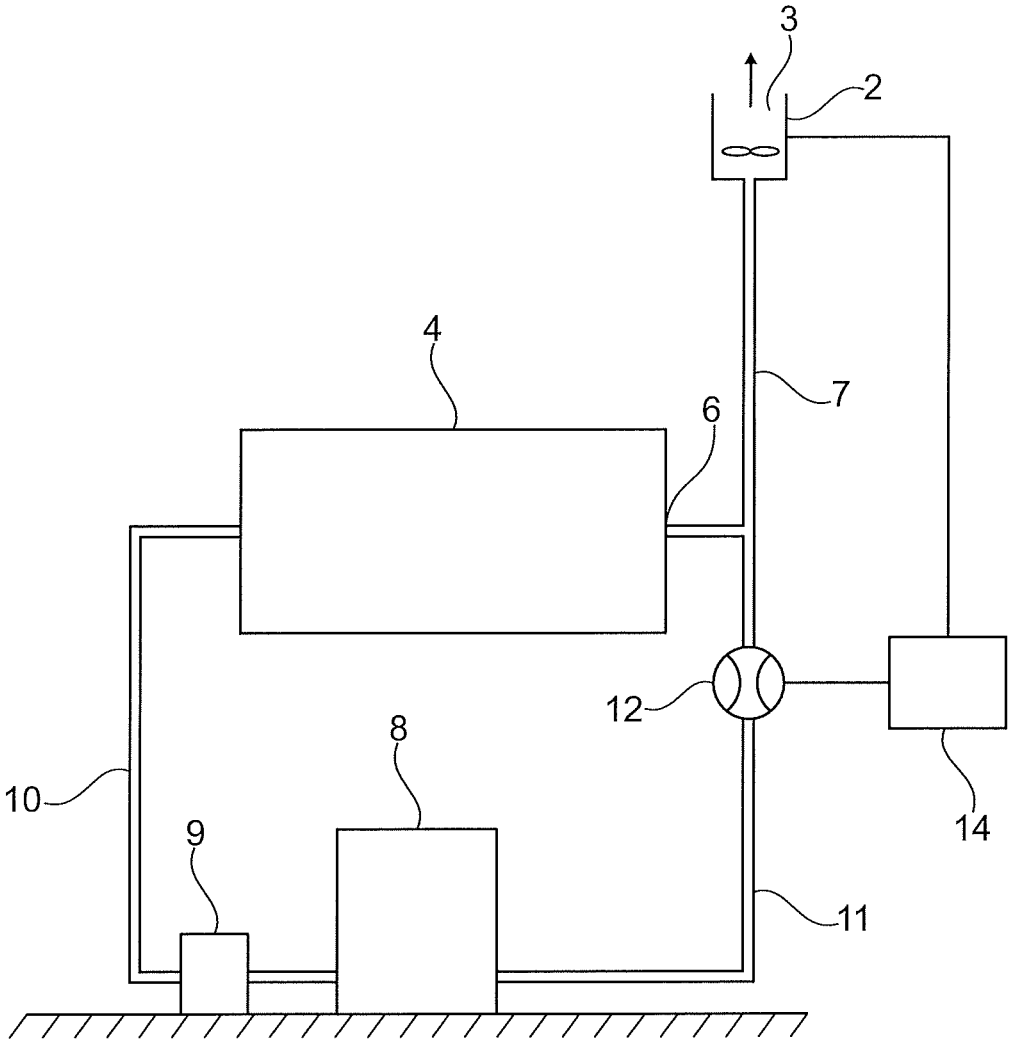
FIG. 5 is a schematic representation of a second embodiment of the invention.

An alternative embodiment will now be explained with reference to FIG. 5. The water that leaves the elongated collector through the exit opening 6 may be recirculated to the source of water 8 through a recirculation duct 11 and a flow meter 12 may be connected to the recirculation duct 11 to measure the flow of water that exits from the elongated collector 4. The flow meter 12 is connected to a logic control unit 14 that can reduce the underpressure in the elongated collector 4 in the same way as described with reference to FIG. 4, i.e. it can change rotational speed and/or pitch of the fan 3 or it can completely shut off the fan 3.

Figure 6:
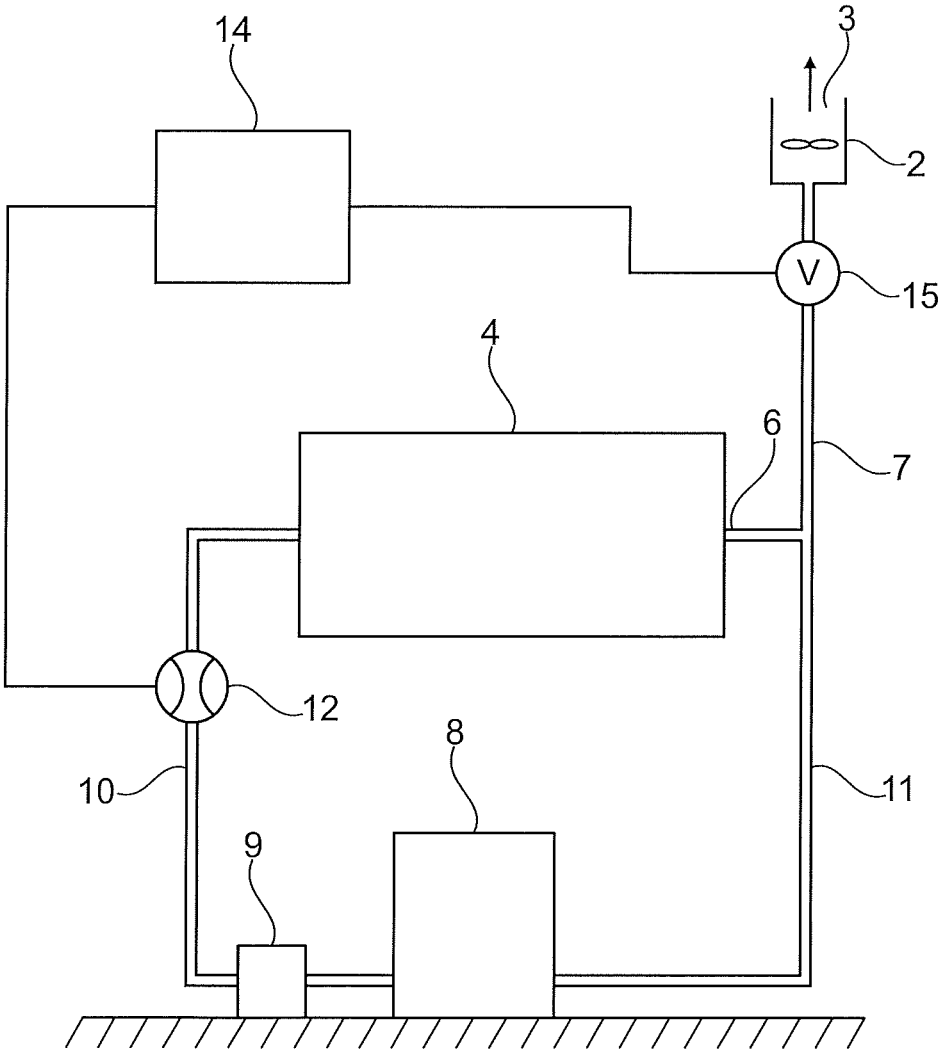
FIG. 6 is a schematic representation of a third embodiment of the invention.

Yet another embodiment will now be explained with reference to FIG. 6. In FIG. 6, the flow meter 12 is shown as being placed to measure the flow in the water supply duct 10 but it could also be placed to measure the flow in the recirculation duct 11. The difference in relation to the embodiments of FIG. 4 and FIG. 5 is that, in the embodiment of FIG. 6, the logic control unit to which the flow meter 12 sends a signal representing the measured value for the water flow, the logic control unit 14 is connected to a control valve 15 that is placed in the suction duct 7. If the signal from the flow meter 12 indicates that the flow of water in the water supply duct 10 is too small, the logic control unit 14 will cause the control valve 15 to either reduce the flow of air through the suction duct 7 or completely close the suction duct 7 such that the exit opening 6 of the elongated collector 4 is no longer in contact with the source of underpressure 2.

Figure 7:
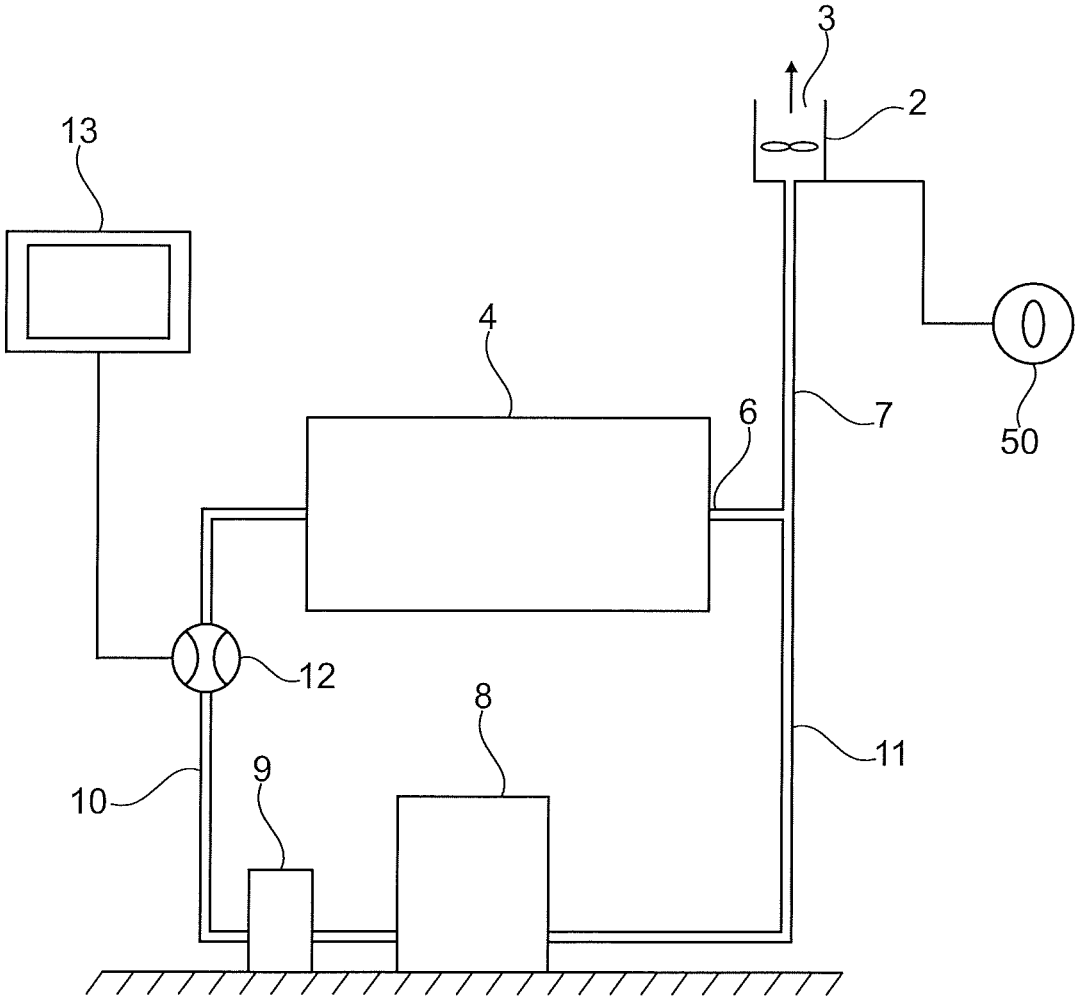
FIG. 7 is a schematic representation of a fourth embodiment of the invention.

Optionally, the control valve 15 may be set to a position in which air is drawn from another place than from the exit opening 6 of the elongated collector 4. Yet another embodiment will now be explained with reference to FIG. 7. In FIG. 7, the signal from the flow meter 12 is sent to a display 13 that displays the measured value for the flow of water through the water supply conduit 12 or, alternatively, the recirculation conduit 11. A human operator can monitor the values displayed on the display 13. If the human operator sees that the values are too low, he or she can use a switch 50 connected to the source of underpressure 2 and switch off the fan 3 or reduce the effect of the fan 3. Alternatively, the switch 50 could be used to operate a control valve 15 as explained with reference to FIG. 6.

It should be understood that the various embodiments can be combined with each other. For example, a flow meter 12 could be connected to both a water supply conduit 10 and a recirculation conduit 11 and both of those flow meters 12 may be connected to a logic control unit 14 or a display 13 in combination with a switch 50. If the signal from either one of the flow meters 12 indicate that the flow of water is insufficient, the source of underpressure 2 can be caused to reduce its effect or it could be disconnected by means of a control valve 15. Embodiments are also conceivable in which one or several flow meters 12 are connected to both a logic control unit 14 and to a display 13. If, for any reason, the logic control unit 14 should fail to reduce underpressure in the elongated collector 4 when the flow of water is insufficient, a human operator can still see on the display 13 that action needs to be taken and use the switch 50.

Of course, if the measured values never indicate that the flow of water is too low, no action needs to be taken to reduce underpressure in the elongated collector.

Thanks to the present invention, the risk that dry dust will accumulate due to an interruption of the water supply to the elongated collector 4 is reduced. Thereby, the danger of fire is reduced.

While the invention has been described above in terms of a method and a system, it should be understood that these categories only reflect different aspects of one and the same invention. The method may thus comprise steps that would be the inevitable result of operating the inventive system, regardless of whether such steps have been explicitly mentioned or not.

The invention claimed is:

1. A system (1) for handling dust in a paper-making environment, the system (1) comprising:

a source of underpressure (2) comprising a fan (3);

an elongated collector (4) that extends along a longitudinal axis and which elongated collector (4) is connected to the source of underpressure (2) through at least one suction duct (7) such that underpressure can be generated inside the elongated collector (4), the elongated collector (4) having an inlet (5) through which dust-laden air can enter the elongated collector (4) and an exit opening (6) leading to the suction duct (7) through which exit opening (6) dust-laden air can be evacuated from the elongated collector (4); and a source of water (8) connected by at least one water supply duct (10) to the elongated collector (4) such that water from the source of water (8) can be introduced into the elongated collector so that dust in the dust-laden air can be exposed to and mix with the water introduced into the elongated collector (4), wherein:

a flow meter (12) is functionally connected to the system (1) to measure at least one of a flow of water from the source of water (8) to the elongated collector (4) or a flow of water exiting from the elongated collector (4) through the exit opening (6) of the elongated collector (4);

the flow meter (12) is configured to send a signal to a logic control unit (14) indicating a numerical value for a flow of water that reaches or leaves the elongated collector (4); and the logic control unit (14) is configured to, upon automatic determination that the indicated numerical value is below the predetermined minimum value, automatically control at least one of the source of underpressure (2) or a control valve (15) located in the suction duct to automatically interrupt an air flow provided within the elongated collector (4) to reduce the underpressure generated therein.

2. The system according to claim 1, wherein the inlet (5) of the elongated collector (4) is disposed in such a relation to the longitudinal axis of the elongated collector (4) that upon drawing the dust-laden air into the elongated collector (4), the air flow provided is an air vortex induced with the dust-laden air, wherein the induced air vortex flows between the collector inlet (5) and the collector exit opening (6).

3. The system according to claim 1, wherein at least one pump (9) is arranged to feed water from the source of water (8) through the at least one supply duct (10) to the elongated collector (4).

4. The system according to claim 1, wherein the flow meter (12) is further configured to send the signal to a display (13) that indicates the current value of the flow of water that reaches or leaves the elongated collector (4) such that a human operator can compare that value to the predetermined minimum value.

5. The system according to claim 1, wherein the logic control unit (14) is connected to the fan (3) and set to completely interrupt the action of the fan (3) when the signal from the flow meter (12) indicates that the flow of water is lower than the predetermined minimum value.

6. The system according to claim 5, wherein the flow meter (12) is placed in the water supply duct (10) that leads from the source of water (8) to the elongated collector (4).

7. The system according to claim 6, wherein the logical control unit (14) is set to completely interrupt the connection between the source of underpressure (2) and the elongated collector (4).

8. A method of handling dust in a paper-making environment, the method comprising the steps of:

providing a source of underpressure (2) comprising a fan (3);

providing an elongated collector (4) that extends along a longitudinal axis and connecting the elongated collector (4) to the source of underpressure (2) through a suction duct (7) such that an underpressure is generated inside the elongated collector (4) that draws dust-laden air and into the elongated collector, the elongated collector (4) having an inlet (5) through which dust-laden air can enter the elongated collector and an exit opening (6) leading to the suction duct (7) through which exit opening (6) dust-laden air can be evacuated from the elongated collector (4);

supplying water to the elongated collector through a water supply duct (10) connected to the elongated collector (4) such that water is introduced into the elongated collector (4) and mixes with the dust in the dust-laden air and leaves the elongated collector (4) through the exit opening (6) so that there will also be a flow of water leaving the elongated collector (4);

measuring, via a flow meter (12), at least one of the flow of water in the supply duct (10) or the flow of water leaving the elongated collector (4);

automatically, via a logic control unit (14), comparing the measured flow of water to a predetermined minimum value; and upon automatic determination that the indicated numerical value is below the predetermined minimum value, automatically controlling, via the logic control unit (14), at least one of the source of underpressure (2) or a control valve (15) located in the suction duct to automatically interrupt an air flow provided within the elongated collector (4) to reduce the underpressure generated therein.

* * * * *